United States Patent [19]

Palmer

[11] Patent Number: 4,719,035

[45] Date of Patent: Jan. 12, 1988

[54] CORROSION INHIBITOR FORMULATION FOR MOLYBDENUM TUNGSTEN AND OTHER METALS

[75] Inventor: Miles R. Palmer, Kirtland, N. Mex.

[73] Assignee: The United States of America as represented by the Secretary of the Air Force, Washington, D.C.

[21] Appl. No.: 913,612

[22] Filed: Sep. 26, 1986

Related U.S. Application Data

[63] Continuation of Ser. No. 675,115, Jan. 27, 1984.

[51] Int. Cl.[4] ..... C09K 3/00; C23F 11/04

[52] U.S. Cl. ..... 252/390; 422/12

[58] Field of Search ..... 252/390; 422/12, 16

[56] References Cited

U.S. PATENT DOCUMENTS

| | | | |
|---|---|---|---|
| 3,425,954 | 2/1969 | Ruzevick et al. | 252/392 |
| 3,553,137 | 1/1971 | Woods | 252/75 |
| 4,134,959 | 1/1979 | Wenke et al. | 422/16 |
| 4,138,353 | 2/1979 | Lipinski | 422/12 X |
| 4,149,969 | 4/1979 | Robitaille et al. | 252/390 X |
| 4,219,433 | 8/1980 | Manabe et al. | 422/16 X |
| 4,317,744 | 3/1982 | Levi | 252/390 X |
| 4,324,675 | 4/1982 | Barthold et al. | 252/79 |

FOREIGN PATENT DOCUMENTS

| | | | |
|---|---|---|---|
| 2841908 | 4/1979 | Fed. Rep. of Germany . | |
| 29441 | 3/1977 | Japan | 422/16 |
| 130478 | 10/1981 | Japan | 422/16 |

*Primary Examiner*—Matthew A. Thexton

*Attorney, Agent, or Firm*—Stanton E. Collier; Donald J. Singer

[57] ABSTRACT

The corrosion of molybdenum metal surfaces which come in contact with water-coolant systems is inhibited by the addition of a small amount of a composition containing a combination of a triazole inhibitor, a biocide and a buffering agent. A corrosion inhibiting composition containing benzotriazole as the inhibitor and benzoic acid as both a biocide and buffer proved to be especially effective in preventing the corrosion of molybdenum, tungsten and other metals.

5 Claims, No Drawings

CORROSION INHIBITOR FORMULATION FOR MOLYBDENUM TUNGSTEN AND OTHER METALS

STATEMENT OF GOVERNMENT INTEREST

The invention described herein may be manufactured and used by or for the Government for governmental purposes without the payment of any royalty theroen.

This application is a continuation of Ser. No. 675,115, filed Jan. 27, 1984.

BACKGROUND OF THE INVENTION

This invention relates to a corrosion inhibiting composition. In a more particular aspect, this invention concerns itself with a water soluble composition to be added to a water-coolant system used to cool equipment operating at elevated temperatures. The corrosion inhibiting composition of this invention is especially useful in high energy laser operations to inhibit the corrosion of molybdenum laser mirrors which come in contact with the water of the laser cooling system.

A recent analysis of laser mirror systems indicated that their failure, or near failure, is due to the degradative effects resulting from their exposure to corrosive contaminants contained in the water used to cool the mirrors. Water cooled molybdenum mirrors, which are used in high energy laser systems, are especially susceptible to corrosion which has led to catastrophic failures of the mirror systems.

As a result, a considerable research effort was undertaken in an attempt to provide a means for preventing corrosion of molybdenum high energy laser mirrors. The research effort culminated in a solution to the corrosion problem and the development of the corrosion inhibiting composition of this invention. The composition is composed of a triazole inhibitor, such as benzotriazole, a biocide and a buffering agent, such as benzoic acid. The composition is added to the cooling water utilized in cooling the molybdenum laser mirror. The benzotriazole acts as the inhibiting agent while the benzoic acid prevents biological degradation of the cooling water. The benzoic acid also buffers the cooling water to an acidic pH for optimum inhibitor performance. The composition of this invention has been found to be especially effective in preventing the corrosion of molybdenum metal surfaces and can be used with little or no modification to the molybdenum mirror systems used in high energy lasers.

SUMMARY OF THE INVENTION

This invention relates to a composition for use in preventing or significantly retarding the corrosive degradation of metal surfaces, especially molybdenum and tungsten metals. The inhibiting composition of this invention is composed of three components: a triazole corrosion inhibitor, a pH buffering agent, and a biocide. Benzotriazole is the preferred inhibitor with benzoic acid functioning preferably as both a buffering agent and biocide. It has been found to be most effective in preventing corrosion of molybdenum and tungsten. It is also relatively effective for inhibiting iron and steel corrosion. The biocide is necessary to prevent biological infestations from destroying the inhibitor or the buffer which provides the proper acidity for optimum effectiveness.

Accordingly, the primary object of this invention is to provide a novel corrosion inhibiting composition capable of protecting non-ferrous metals, such as molybdenum and tungsten, and ferrous metals, such as iron and steel, from the degradative effects of corrosion.

Another object of this invention is to provide corrosion protection for metal structures that come in contact with an aqueous corrosive solution.

Still another object of this invention is to provide a corrosive inhibiting composition that can be added to the cooling system of molybdenum mirrors used in high energy laser systems.

The above and still other objects and advantages of the present invention will become more readily apparent upon consideration of the following detailed disclosure thereof.

DESCRIPTION OF THE PREFERRED EMBODIMENTS

The use of water-coolant systems for high energy lasers is well known. The system provides water for conditioning and cooling mirrors and apertures/beam clippers located along the high power beampath of high energy lasers. Generally, molybdenum metal is utilized as the material for constructing high energy laser mirrors.

Pure molybdenum offers a number of advantages as a material for constructing water cooled laser mirrors. It has high stiffness, a low coefficient of thermal expansion, and high thermal conductivity. These properties minimize thermal distortion of the optical surface of the mirror.

The mirror structures must be made as thin as possible in order to minimize thermal distortion. Because the mirror structures are relatively thin, they cannot withstand a large amount of material loss due to corrosion without distorting or totally failing.

Unfortunately, molybdenum mirrors fail, or nearly fail, after a few months of operation due to distortion in the mirror surface. In an attempt to determine the cause of failure, a metallurgical analysis of the mirrors was undertaken and it indicated that the degradation of the mirrors was due primarily to simple corrosion. No correlation of corrosion rates with mirror type or location could be determined. The corrosion appeared to occur relatively uniformly within each mirror and amounted to a corrosion rate of about 0.5 to 3.0 mils per year (MPY). Another contributing factor to failure of the molybdenum mirrors was determined when it was found that biological growth had contaminated the water cooling system. It was found that the coolant had caused severe corrosion in various parts of the system, namely to molybdenum and aluminum components. Biological contamination of the cooling water was so severe that it caused plugging of filters due to biological slime formation. the biofouling led to large variations in the pH and conductivity of the cooling water. These changes would have been expected to increase the corrosion of iron and copper components in the system that, in turn, would increase the molybdenum corrosion rate. As a result, a research program was conducted to determine materials compatibility, biological contamination and control, and corrosion suppression. As a result of this program, it was found that a chemical additive benzotriazole, was found to inhibit the corrosion of molybdenum in water. However, the inhibition is dependent upon pH. The addition of another chemical additive, benzoic acid, to buffer the pH worked well and also inhibited bacterial growth. The combination was compatible with other nonmetals used in the cooling system. Both the corrosion inhibitor and biocide additives are relatively safe to handle and are noncarcinogenic. There was no significant gas phase absorption at the $CO_2$ wavelength for the vapor of either compound at room temperature.

In essence, the corrosion inhibiting composition of this invention consists of three components: a triazole corrosion inhibitor, a pH buffering agent, and a biocide. The triazole, in concert with the buffering agent's maintenance of an acidic environment, inhibits corrosion of molybdenum and tungsten almost totally. It is also relatively effective for inhibiting iron and steel corrosion. The biocide is necessary to prevent biological infestations from destroying the inhibitor or the buffer.

The triazole may be any substituted derivative of benzotriazole. Tolyltriazole is one example found to be as effective as benzotriazole. Tolyltriazole is simply a methyl substituted benzotriazole, with the methyl group occupying any one of the four possible positions on the benzene ring. The tolyltriazole used in this invention is a mixture of the isomers with the methyl group in the 4 and 5 positions. Various other hydrocarbon grups could be substituted for the methyl radical, and multiple substitution would also be possible. As long as the basic triazole functional grouping was not radically affected, the derivatives would function as inhibitors.

Other possible buffering agents could be used in lieu of benzoic acid. Tartaric acid, phosphoric acid, citric acid, phthalic acid, acetic acid and formic acid could be used. The solution pH can easily be modified by addition of small amounts of bases such as sodium hydroxide. The exact pH desired would be a function of the makeup of the cooling system. The presence of aluminum or iron in the system would dictate that the pH be maximized (but remain below 5). In all stainless steel systems, a pH below 3 would be preferred.

The biocide can be any organic compound which is effective in eliminating bacterial and fungal growth. Irorganic biocides such as mercury compounds, the chromates, and hypochlorite are not acceptable due to their deleterious effects on corrosion inhibition. Organic biocides which are effective include: formaldehyde; methyl paraben; phenoxyethanol; etylene oxide; 2, 4 dichlorobenzyl alcohol; and imidazolidinyl urea; among others.

Table I, which follows, shows the effective concentration ranges for each of the three components. In general, the most effective concentration would be employed for each specific system as determined by simple corrosion engineering tests employed in the industry. Concentrations are in moles per liter.

TABLE I

| | |
|---|---|
| Triazole Inhibitor | .0002–0.1 |
| Biocide | .005–0.1 |
| Buffer | .01–0.1 |

Most high energy laser (HEL) cooling systems contain a large number of different materials in the mirror cooling loop. Consequently, any inhibitor chosen for use is required to be compatible with all loop materials as well as providing a low molybdenum corrosion rate. Those compatibility criteria are outlined in Table II.

In addition to meeting the criteria of Table II, the inhibitor is required to prevent biological infestation of the water system. This is necessary to prevent fouling of the system water filters with biological waste products and to prevent biodegradation of the inhibitor itself.

It is necessary to assume that spills of the coolant fluid will occur. It must also be assumed that the spill cannot be completely cleaned up. This could present several problems. If the inhibitor is toxic, it could present a safety problem to personnel. The spilled fluid might react with and damage mirror optical coatings. Lastly, volatile residues of the inhibitor might cause thermal blooming of the high energy laser beam. Therefore, the inhibitor must be relatively non-toxic.

The inhibitor must also not damage the HEL mirror optical coatings upon contact and be removable using a water or alcohol cleaning procedure. No volatile component capable of causing thermal blooming is allowable, and, as stated above, as low a toxicity as possible.

A particular inhibitor composition which was tested and found to meet the molybdenum corrosion and materials compatibility criteria described in Table II was one in which benzoic acid was utilized as both a buffering agent and biocide. The specific composition and corrosion rate is designated No. 2 in Table II.

TABLE II

| PARAMETER | ACCEPTABILITY CRITERION |
|---|---|
| Mo Corrosion Rate | Less than 0.3–0.6 mpy |
| Corrosion Rate of Other System Metals | Less than 3 mpy |
| Degradation of System Nonmetals | No significant degradation in 3 week test |

NOTE:
Corrosion rates for system metals other than Mo were carried out by standard coupon tests using 0.5 × 2 inch coupons. The coupons were clamped to a 1 inch 304 stainless steel square in each case to stimulate the galvanic coupling environment typically found in the cooling system. Testing of the nonmetals was carried out by ASTM methods D412, D2240, and D471. Changes in hardness of less than 2, in elongation and tensile strength of less than 10% and volume changes of less than 7% were viewed as not significant.

TABLE III

| Mo | INHIBITOR | Grams/ LITER | CORROSION RATE (MPY) |
|---|---|---|---|
| 1 | None | — | 3.3 |
| | | | <0.1 |
| | Benzotriazole | 2 | |
| 2 | Benzoic Acid | 1 | |

Conditions as in Table VI, except all the Mo/Au coupons.

The benzotriazole inhibitor meets all of the criteria thus far outlined. It yields a corrosion rate for molybdenum of less than 0.1 mpy. The corrosion rate for all other system metals is less than one mpy and no significant degradation of the nonmetals in the system was found. The combination was found to not measureably affect coated mirror surfaces, being easily removed with alcohol. No gas phase absorption in the HEL wavelength band was found in a gas phase saturated with a vapor of either inhibitor component. Finally, the inhibited coolant is of very low toxicity (minimum lethal dose greater than 20 gallons, based on toxicity of benzotriazole and benzoic acid), and can be disposed of directly into a municipal sewer system.

The benzotriazole inhibitor thus meets all of the established criteria for the coolant. The particular composition shown in Table III designated No. 2, has been found most effective for a molybdenum mirror cooling system. The exact concentrations of the two components were chosen on the basis of tests shown in Table IV and Table V. The minimum required concentration of benzotriazole appears from Table IV to be a 0.02% concentration, but ten times higher was chosen to ensure maximum corrosion inhibition. Table V shows that a low, or acidic, pH is necessary for optimum corrosion inhibition. In addition to inhibiting biological growth, 0.1% of benzoic acid provides a solution pH of 3.2, and buffers the coolant against fluctuations of pH into the basic region above pH7.

Table VI presents additional corrosion tests for molybdenum coupons as well as for partially gold coated molybdenum test coupons.

TABLE IV

| % BENZOTRIAZOLE | Mo CORROSION RATE (MPY) |
|---|---|
| 0.5 | <0.1 |
| 0.2 | <0.1 |
| 0.1 | <0.1 |
| 0.02 | 0.14 |
| 0.01 | 0.44 |
| 0.005 | 3.2 |
| 0.001 | 3.5 |
| 0 | 4.2 |

Conditions as for Table VI. All with 0.2% benzoic acid. All at a pH of 4.0 adjusted with NaOH.

TABLE V

| pH | Mo CORROSION RATE (MPY) |
|---|---|
| 2 | <0.1 |
| 3 | <0.1 |
| 4 | 0.1–0.2 |
| 4.4 | 0.2–0.3 |
| 5 | 0.2–0.3 |
| 6–7 | 0.4 |
| 7–8 | 1.4 |
| 8.1 | 2.0 |
| 9.5 | 4.0 |

All with 0.2% benzotriazole and 0.2% benzoic acid. Adjusted pH with NaOH and $H_2SO_4$.

TABLE VI

| | CORROSION RATE (MPY) | |
|---|---|---|
| SOLUTION | Mo | Mo/Au |
| DIW | 0.5 | 1.3 |
| DIW + Fe | 2.7 | — |
| DIW + Cu | 4.2 | — |
| DIW + Fe + Cu | 4.4 | |
| DIW + Fe, Cu, Ni, Cr | — | 3.3 |

Test period 3 weeks. At 29.5 C. with shaking at 2 oscillations per second with 3 inch stroke. DIW = deionized water. Each metal 0.5 mM as the sulfates: Fe(III), Cu(II), Ni(II), and Cr(III). Solutions were 50 cc in 100 cc polyethylene bottles. Coupons were 1.5 × 4 × 0.076 cm sintered Mo cut from mirror faceplate material. The Mo/Au coupons were half coated with the gold braze alloy used in HEL mirrors.

From a consideration of the above, it can be seen that the present invention provides a novel application of a triazole, buffering agent, and a biocide to a high energy laser mirror cooling system; as well as the addition of a triazole under acidic conditions with a biocide to any cooling water system. The corrosion inhibiting composition of this invention slows the corrosion rate of molybdenum high energy laser mirrors between 10 and 100 fold. These mirrors are very costly and difficult to replace. Extending their lifetime from the current minimum of about a year to many years through the use of this inhibitor offers great economic and operational performance advantages. The inhibitor also greatly slows copper, iron, and aluminum corrosion. It also stabilizes the cooling water properties, thus providing more predictable behavior of the coolant.

The development of the triazole based inhibitors of this invention and their effectiveness in controlling the aqueous corrosion of molybdenum and tungsten surfaces can materially increase the operational cost effectiveness of high energy laser mirror systems. The inhibitors exhibit excellent potential for replacing other inhibitors in corrosion resistance applications thereby overcoming the environmental and ecological problems often encountered when using other inhibitors.

While the invention has been described with particularity in reference to specific embodiments thereof, it is to be understood that the disclosure of the present invention is for the purpose of illustration only and is not to be construed as limiting the invention in any way, the scope of which is defined by the appended claims.

What is claimed is:

1. An aqueous cooling system contacting molybdenum or tungsten laser mirrors, wherein the improvement comprises an aqueous corrosion inhibiting composition having a pH of less than 4 and consisting essentially of:

(a) a triazole selected from the group consisting of benzotriazole and tolyltriazole, said triazole having a concentration of 0.0002 to 0.1 moles per liter;

(b) an organic biocide having a concentration of 0.005 to 0.1 moles per liter; and (c) a buffering agent selected from the group consisting of benzoic acid, tartaric acid, phosphorous acid, citric acid, phthalic acid, acetic acid and formic acid, at a concentration of 0.01 to 0.1 moles per liter.

2. The system as defined in claim 1 wherein the mirror is molybdenum.

3. The system as defined in claim 1 wherein the biocide and buffering agent are each benzoic acid.

4. The system as defined in claim 1 wherein the triazole is benzotriazole.

5. The system as defined in claim 1 wherein the triazole is tolyltriazole.

* * * * *